US008418873B2

(12) United States Patent
Kastner

(10) Patent No.: US 8,418,873 B2
(45) Date of Patent: Apr. 16, 2013

(54) TRASH RECEPTACLE WITH VACUUM RELEASE VENTS

(76) Inventor: David Kastner, Stanhope, NJ (US)

( * ) Notice: Subject to any disclaimer, the term of this patent is extended or adjusted under 35 U.S.C. 154(b) by 267 days.

(21) Appl. No.: 12/662,865

(22) Filed: May 7, 2010

(65) Prior Publication Data

US 2011/0253724 A1 Oct. 20, 2011

Related U.S. Application Data

(63) Continuation-in-part of application No. 12/662,419, filed on Apr. 16, 2010.

(51) Int. Cl.
*B65D 25/14* (2006.01)

(52) U.S. Cl.
USPC ..... 220/495.06; 220/908; 220/908.1

(58) Field of Classification Search ..... 220/495.04, 220/495.06, 676, 652, 692, 908.1, 908; 229/117.29
See application file for complete search history.

(56) References Cited

U.S. PATENT DOCUMENTS

| | | | | |
|---|---|---|---|---|
| 4,294,379 | A | 10/1981 | Bard | |
| 5,167,343 | A * | 12/1992 | Winfrey et al. | 100/102 |
| 5,492,241 | A | 2/1996 | Barnett et al. | |
| 6,015,063 | A | 1/2000 | Poliquin | |
| 6,079,759 | A * | 6/2000 | Payne et al. | 294/32 |
| 6,634,518 | B1 | 10/2003 | Jones | |
| 6,736,281 | B2 | 5/2004 | Joseph | |
| 7,438,199 | B1 * | 10/2008 | Tidrick | 220/495.04 |
| 7,578,409 | B1 * | 8/2009 | Kulasik | 220/495.04 |
| 7,641,067 | B2 * | 1/2010 | McCurry | 220/495.04 |
| 8,079,489 | B1 * | 12/2011 | Welch | 220/495.04 |
| 2007/0210088 | A1 | 9/2007 | Wentz et al. | |
| 2009/0255934 | A1 | 10/2009 | Herndon | |
| 2011/0253723 | A1 * | 10/2011 | Kastner | 220/495.04 |

* cited by examiner

*Primary Examiner* — Bryon Gehman
*Assistant Examiner* — Shawn Braden
(74) *Attorney, Agent, or Firm* — Lawrence G. Fridman

(57) ABSTRACT

A vented trash receptacle has integral or insertable elongated rectangular panels, which can be flat or convex. The panels create vertical airways along the corners or sides of the trash receptacle, such that air can enter at the top of the panel and flow down the sides of the receptacle and into the bottom below the liner bag. To prevent obstruction of the airway by the liner, the vent panel can be perforated at intervals along its length, and/or it contain a vent opening at its lower edge.

6 Claims, 4 Drawing Sheets

TRASH RECEPTACLE WITH VACUUM RELEASE VENTS

REFERENCE TO RELATED APPLICATION

This application is a continuation-in-part of U.S. application Ser. No. 12/662,419, filed Apr. 16, 2010, which is incorporated herein.

BACKGROUND OF THE INVENTION

The current invention relates to the field of trash receptacles, and more particularly to trash receptacles that incorporate a means of releasing the vacuum typically created between the liner bag and the inner walls and bottom of the receptacle.

Trash receptacles come in a variety of shapes and sizes and are commonly used in domestic, commercial and industrial applications. In order to avoid contamination of the interior of such receptacles, a plastically deformable liner bag is usually inserted into the receptacle, such that the liner covers the side walls and bottom of the receptacle and extends around the perimeter of the receptacle opening. As the liner bag is filled with trash, it is compressed against the sides and bottom of the receptacle. This compression forces the air out of the spaces between the liner and the interior of the receptacle, thereby creating a partial vacuum, which offers strong resistance to removal of the liner when the receptacle is full. Such resistance often compels a person to hold down the receptacle with one hand while lifting the liner bag with the other hand. Consequently, the simple task of removing a trash bag from its receptacle is rendered difficult and awkward.

The prior art as it relates to trash receptacles with vacuum release vents is reviewed in U.S. application Ser. No. 12/662,419, of which this application is a continuation-in-part. In addition to the limitations of the prior art discussed in the parent application, the prior art devices do not function properly when the liner bag is tightly attached around the rim of the receptacle. Many of the trash liner bags now in use have elastic or tie cords that seal off the inflow and exhaust of air at the top of the receptacle. A truly functional vacuum release system must allow venting in both directions after the bag has been sealed on the rim of the receptacle. Among the prior art patent documents, only the patent application of Herndon (US 2009/0255934) enables venting when the top of the receptacle is sealed, but the venting taught by Herndon is one-directional—only allowing air inflow, but not allowing exhaust air to escape. This becomes more of a problem with today's drawstring bags that create an airtight seal on the rim of the receptacle and have the potential to create a "reverse balloon effect" if the trapped air cannot be evacuated as the liner bag expands when filled with trash. The design of the present invention, on the other hand, enables venting in both directions, and thereby addresses the vacuum problem during the insertion as well as the removal of the liner after being filled.

There also exists a need, as yet unfulfilled by the prior art, for a vacuum release vent that can be integrally formed in or inserted into an ordinary trash receptacle of virtually any size and shape. The present invention meets this need by providing a series of multi-form vent panel configurations. In versions of the multi-form vents that are designed for receptacles having a square or rectangular opening, insertable or integral flat panels diagonally transect one or more corners of the receptacle to create right-triangular prism-shaped airways that extend from the receptacle's opening to its bottom beneath the liner bag. In other versions of the multi-form panels, which are adaptable to circular or elliptical receptacle openings, as well as square or rectangular openings, convex panels enclose one or more longitudinal columns along an interior or exterior wall of the receptacle to create semi-cylindrical airways that extend from the opening to the bottom beneath the liner bag.

SUMMARY OF THE INVENTION

The present invention comprises trash receptacles that employ a series of multi-form panels to create airways from the opening of a trash receptacle to the bottom, such that the airways prevent the formation of a partial vacuum between the receptacle and liner bag. Each vent creates a vertical airway along the corner or side of the trash receptacle, such that air can enter at the top of the panel and flow down the sides of the receptacle and into the bottom below the liner bag. To prevent obstruction of the airway by the liner, the vent panel can be perforated at intervals along its length, and/or it can contain one or more vent openings along its lower edge.

The first two embodiments of the present invention comprise trash receptacles having a square or rectangular opening. The first embodiment features a vent designed to be integrally formed within the receptacle. In this version, flat, elongated rectangular panels are integrally formed to transect at least one corner, and preferably all four corners, of the receptacle. In this configuration, a right-triangular prism-shaped vertical airway column is integrally formed in the corner(s) of the receptacle, which airway column extends from the receptacle's opening to its bottom. A principal air opening is provided at the bottom of the panel, and secondary airway openings can also be provided at intervals along the length of the panel.

The second embodiment also comprises trash receptacles having a square or rectangular opening. Flat, elongated rectangular panels are slidably insertable so as to transect at least one corner, and preferably all four corners, of the receptacle. Two sets of dual tracks are integrally formed in one or more corners of the receptacle, with the track separation being slightly greater than the thickness of the panel, such that the panel can freely slide up and down between the dual tracks. In this configuration, a right-triangular prism-shaped vertical airway column is slidably formed in the corner(s) of the receptacle, which airway column extends from the receptacle's opening to its bottom. A principal air opening is provided at the bottom of the panel, and secondary airway openings can also be provided at intervals along the length of the panel. The receptacles of the second embodiment, with removable, slidable vent panels, have the advantages of being easy to clean and readily stackable.

The third and fourth embodiments feature trash receptacles with either circular/elliptical or square/rectangular receptacle openings. In the third embodiment, integral convex panels enclose one or more longitudinal columns within the interior of the receptacle to create semi-cylindrical airways that extend from inside the receptacle's opening to the bottom beneath the liner bag. A principal air opening is provided at the bottom of the panel, and secondary airway openings can also be provided at intervals along the length of the panel.

In the fourth embodiment, integral convex panels enclose one or more longitudinal columns along the exterior of the receptacle to create semi-cylindrical airways that extend from inside the receptacle's opening to the bottom beneath the liner bag. A principal air opening from the airway into the interior of the receptacle is provided at the bottom of the receptacle, and secondary airway openings can also be provided in the walls of the receptacle at intervals along the length of the enclosed column.

DETAILED DESCRIPTION OF THE PREFERRED EMBODIMENTS

Figure 1A:
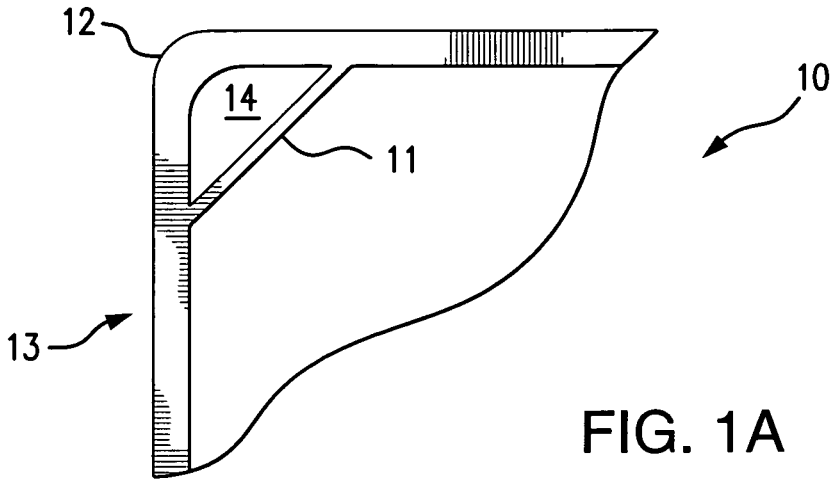
FIG. 1A is a top plan view of a vent in the corner of a trash receptacle in accordance with the first preferred embodiment of the present invention.
Figure 1B:
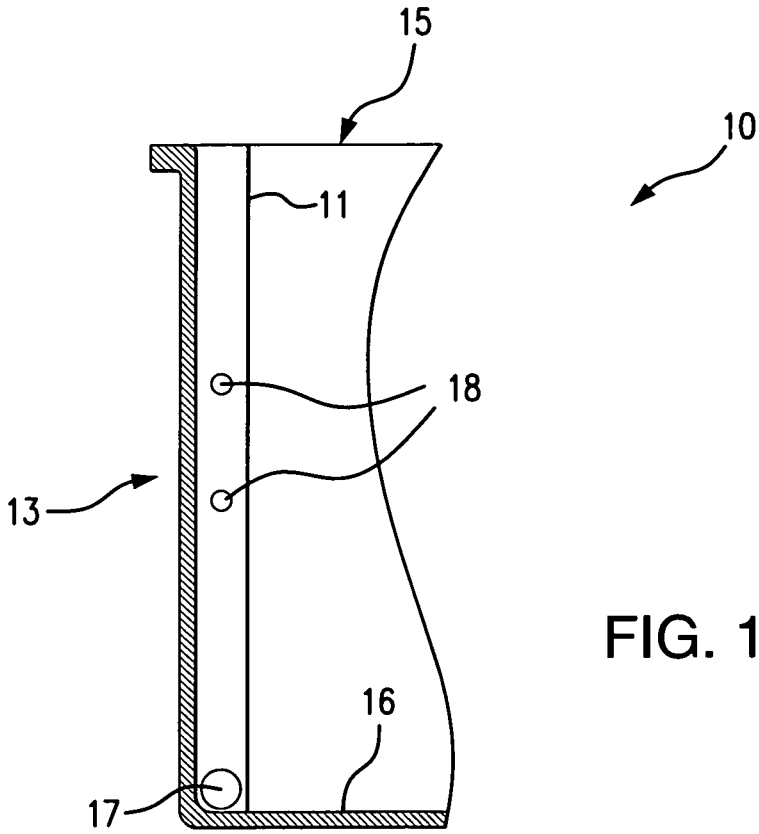
FIG. 1B is a partial cut-away view of the trash receptacle with the vent of FIG. 1.
Figure 2A:
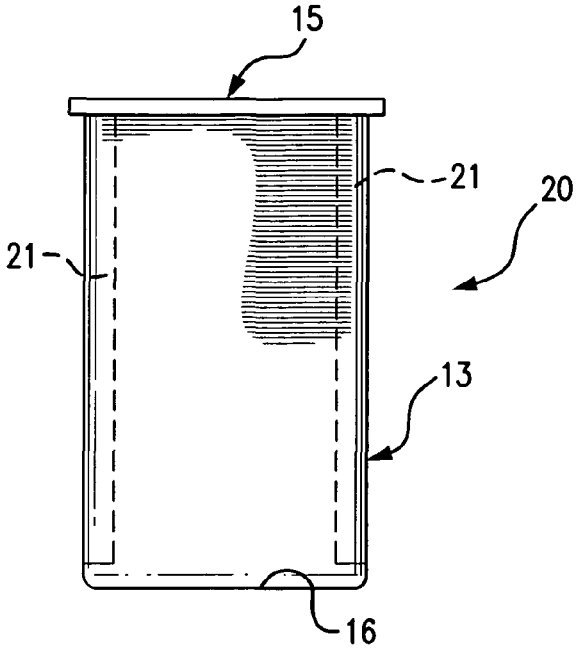
FIG. 2A is a front elevation view of a trash receptacle with the insertable panels of the second preferred embodiment of the present invention shown is ghost view.
Figure 2B:
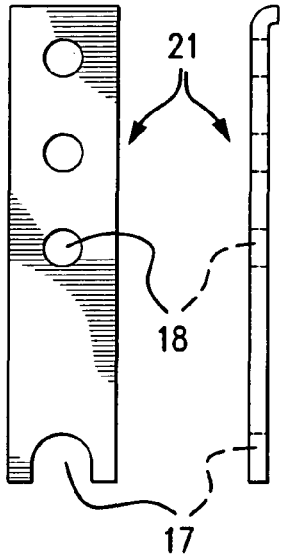
FIG. 2B shows front and side elevation detail views of one of the insertable panels of FIG. 2A.
Figure 2C:
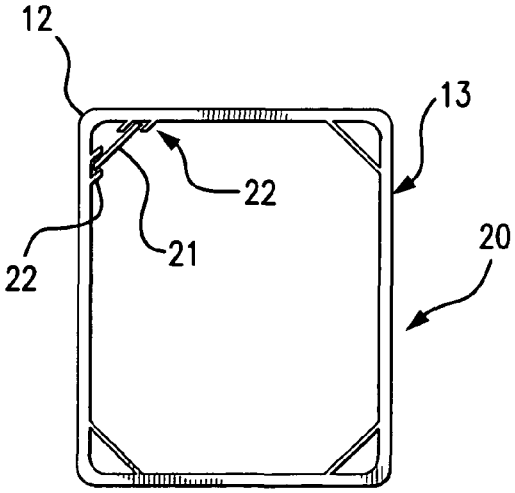
FIG. 2C is a top plan view of the trash receptacle of FIG. 2A showing the insertable panels of FIG. 2B.
Figure 2D:
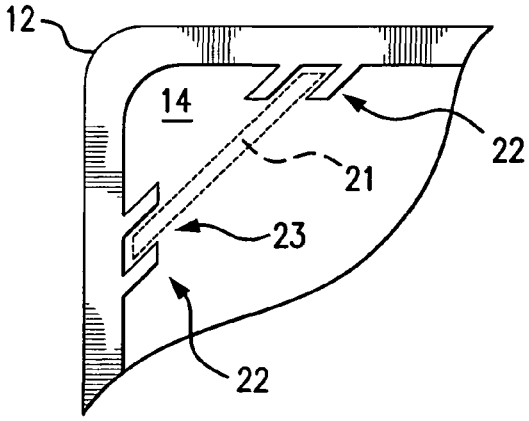
FIG. 2D is a top plan detail view of the dual tracks of the second preferred embodiment, with the insertable panel in ghost view.

Referring to FIGS. 1A and 1B, the first preferred embodiment of the present invention 10 comprises a trash receptacle 13 which has a square or rectangular opening 15 and which has one or more elongated, rectangular, integral flat panels 11 that are integrally formed to transect at least one corner 12, and preferably all four corners, of the trash receptacle 13. In this configuration, a right-triangular prism-shaped vertical airway column 14 is integrally formed in the corner(s) 12 of the receptacle 13, which airway column 14 extends from the receptacle's opening 15 or from near to the receptacle's opening 15 to its bottom 16 or near to its bottom 16. A principal air opening 17 is provided at the bottom of the panel 11, and one or more secondary airway openings 18 can also be provided at intervals along the length of the panel 11.

Referring to FIGS. 2A through 2D, the second preferred embodiment of the present invention 20 comprises a trash receptacle 13 which has a square or rectangular opening 15 and which has one or more elongated, rectangular, insertable flat panels 21 that are slidably insertable so as to transect at least one corner 12, and preferably all four corners, of the trash receptacle 13. Two sets of dual tracks 22 are integrally formed in one or more corners 12 of the receptacle 13, with the track separation 23 being slightly greater than the thickness of the panel 21, such that the panel 21 can freely slide up and down between the dual tracks 22. In this configuration, a right-triangular prism-shaped vertical airway column 14 is slidably formed in the corner(s) 12 of the receptacle 13, which airway column 14 extends from the receptacle's opening 15 or from near to the receptacle's opening 15 to its bottom 16 or near to its bottom 16. A principal air opening 17 is provided at the bottom of the panel 21, and one or more secondary airway openings 18 can also be provided at intervals along the length of the panel 21.

Figure 3A:
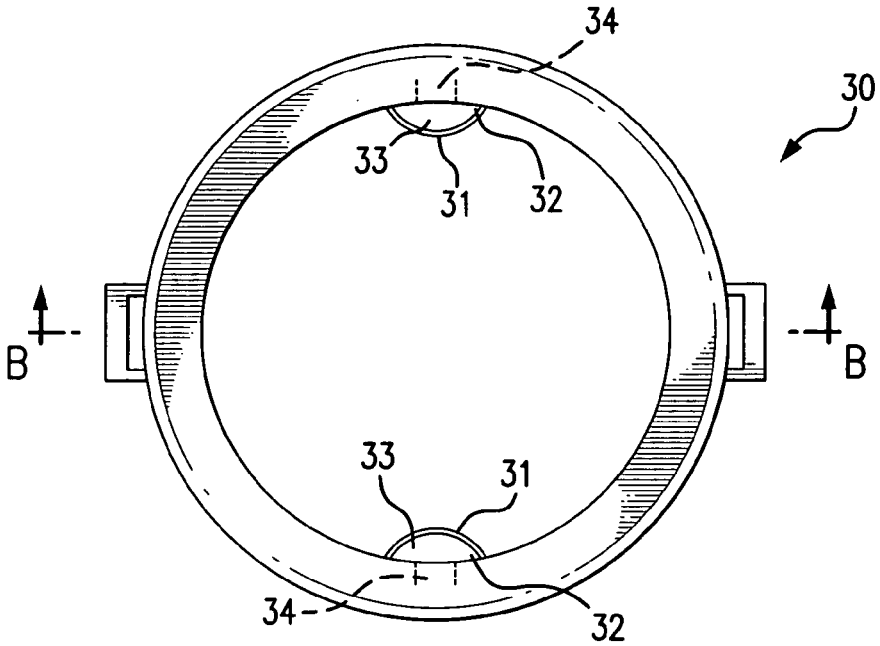
FIG. 3A is a top plan view of a trash receptacle with two vents in accordance with the third preferred embodiment of the present invention.
Figure 3B:
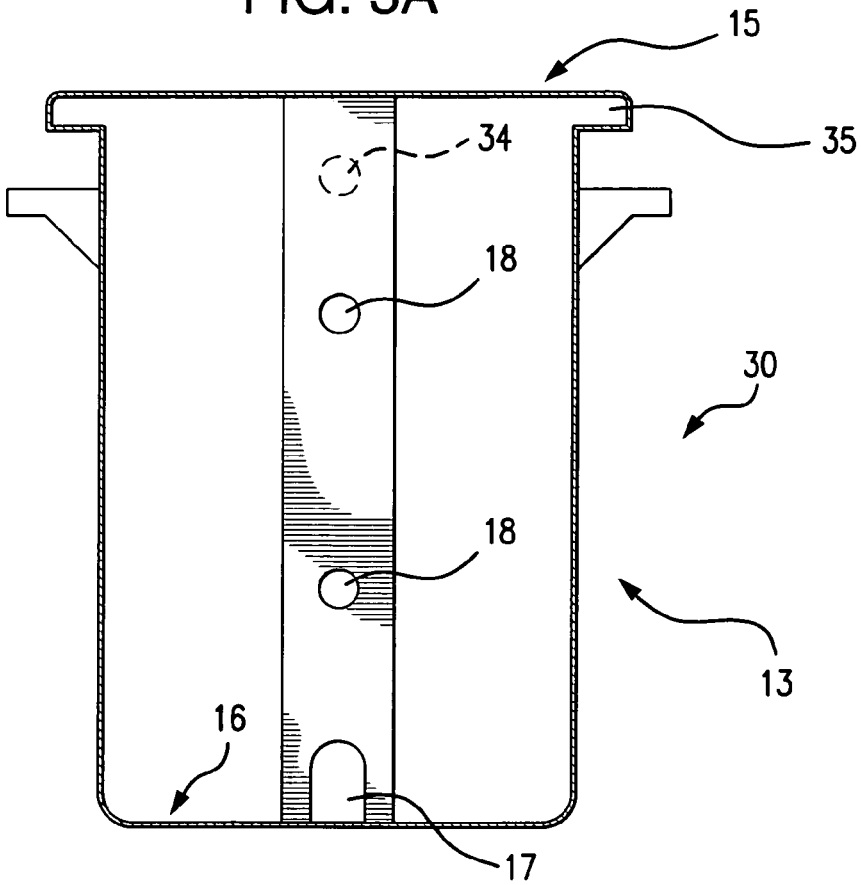
FIG. 3B is a cross-sectional view of the trash receptacle of FIG. 3A taken through the line A-B.

Referring to FIGS. 3A and 3B, the drawings illustrate the third preferred embodiment of the present invention 30 applied to a trash receptacle 13 which has a circular or elliptical opening 15 and which has one or more integral convex interior panels 31 that enclose one or more interior longitudinal columns 32 within the interior of the trash receptacle 13 to create one or more semi-cylindrical interior airways 33 that extend from inside the receptacle's opening 15 to the receptacle's bottom 16 or near to the receptacle's bottom 16. In each panel 31, a principal air opening 17 is provided at the bottom of the panel 31, and one or more secondary airway openings 18 can also be provided at intervals along the length of the panel 31. An exterior airway opening 34 through the receptacle wall into the semi-cylindrical interior airway 33 can also be provided. Optionally, a flanged receptacle opening 35 can also be provided to better secure the liner bag.

Figure 4A:
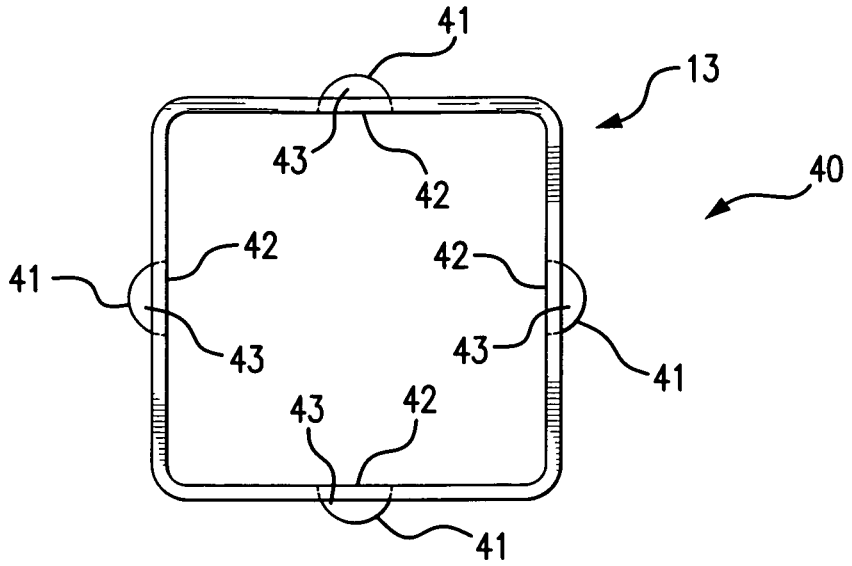
FIG. 4A is a top plan view of a trash receptacle with four vents in accordance with the fourth preferred embodiment of the present invention.
Figure 4B:
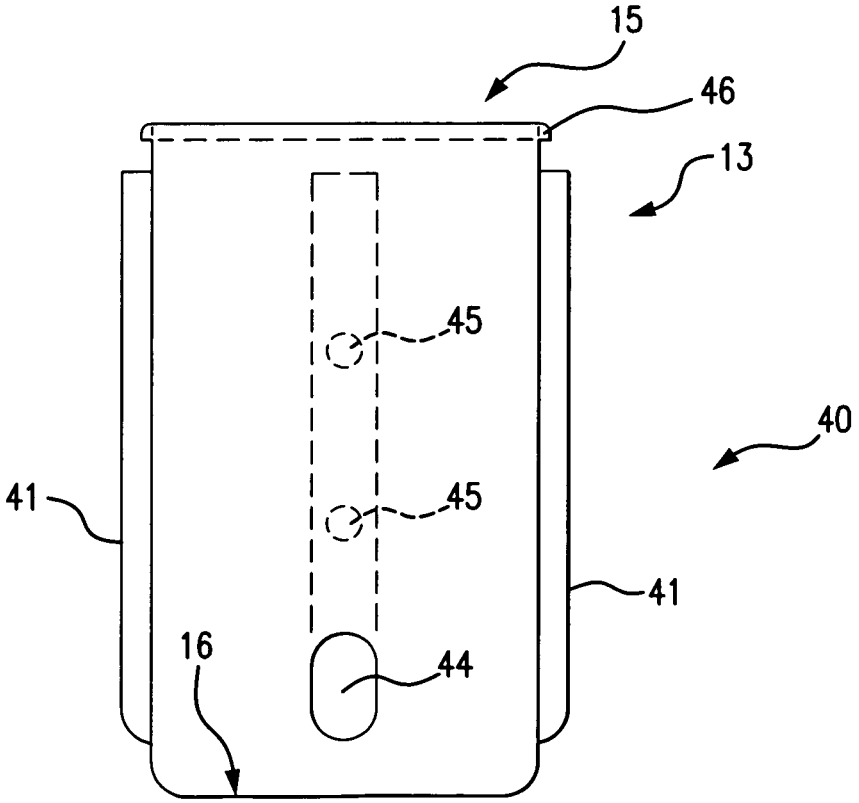
FIG. 4B is a front elevation view of the trash receptacle of FIG. 4A.

Referring to FIGS. 4A and 4B, the drawings illustrate the fourth embodiment of the present invention 40 applied to a trash receptacle 13 which has a circular or elliptical opening 15 and which has one or more integral convex exterior panels 41 that enclose one or more exterior longitudinal columns 42 on the exterior of the trash receptacle 13 to create one or more semi-cylindrical exterior airways 43 that extend from outside the receptacle's opening 15 to the receptacle's bottom 16 or near to the receptacle's bottom 16. A principal exterior air opening 44 from the airway 43 into the interior of the receptacle 13 is provided at or near the receptacle's bottom 16, and one or more secondary airway openings 45 can also be provided in the walls of the receptacle 13 at intervals along the length of the enclosed column 42. Optionally, a flanged receptacle opening 46 can also be provided to better secure the liner bag.

It should be noted that the fourth preferred embodiment, by providing exterior airways 43, does not merely release a partial vacuum formed between the interior of the trash receptacle 13 and a liner bag, but rather it prevents such a partial vacuum from forming in the first place.

Although the preferred embodiments of the present invention has been disclosed for illustrative purposes, those skilled in the art will appreciate that many additions, modifications and substitutions are possible, without departing from the scope and spirit of the present invention as defined by the accompanying claims.

What is claimed is:

1. A trash receptacle with insertable vacuum release vents, comprising:

one or more angular corners formed within an interior of the trash receptacle defined by inner walls thereof;

a receptacle opening at a top of the trash receptacle;

at least one of the angular corners is formed with two sets of dual tracks positioned oppositely to each other, each said set of dual tracks extends from a vicinity of the receptacle opening to a vicinity of a bottom of the trash receptacle;

each said set of dual tracks comprising a pair of spaced from each other substantially parallel guiding members integrally formed with and positioned at an angle to the inner walls of the receptacle, so as to define a continuous receiving space therebetween;

a substantially flat, elongated panel is provided to transect said at least one angular corner, said panel is slidably received within said continuous receiving spaces of the respective pairs of the guiding members, said panel when fully inserted into the receiving spaces substantially vertically extends from the vicinity of the receptacle opening to the vicinity of the bottom of the trash receptacle; and at least one triangular prism-shaped vertical airway columns is formed at said at least one angular corner, said airway column is open at a top and a bottom thereof;

wherein said at least one airway column is enclosed on its sides by the panel and by the inner walls of said at least one angular corner of the trash receptacle, such that when a liner bag is inserted into the interior of the trash receptacle, the at least one airway column prevents creation of a partial vacuum between the liner bag and the interior of the trash receptacle as the liner bag expands upon filling.

2. The trash receptacle according to claim 1, further comprising a principal air opening provided at a bottom of said panel that enables air to flow through the panel.

3. The trash receptacle according to claim 2, further comprising one or more secondary air openings provided along length of the panel that enable additional air to flow through the panel.

4. The trash receptacle according to claim 1, wherein at least one said angular corner comprises four angular corners each provided with the respective set of dual tracks formed to slidably receive the substantially flat elongated panel.

5. The trash receptacle according to claim 4, wherein said at least one triangular prism-shape vertical airway column comprises four triangular prism-shape vertical airway columns provided at each said corner of the trash receptacle.

6. The trash receptacle according to claim 4, wherein each said panel is provided with the respective principle and secondary air openings.

* * * * *